US007397361B2

(12) United States Patent
Paulsen

(10) Patent No.: US 7,397,361 B2
(45) Date of Patent: Jul. 8, 2008

(54) DEVICE FOR SECURITY SYSTEMS FOR OPERATION OF HABITATS ON INSTALLATIONS

(75) Inventor: Nils Paulsen, Bergen (NO)

(73) Assignee: STS Stillasservice, Bergen (NO)

( * ) Notice: Subject to any disclaimer, the term of this patent is extended or adjusted under 35 U.S.C. 154(b) by 150 days.

(21) Appl. No.: 10/519,763

(22) PCT Filed: Jun. 30, 2003

(86) PCT No.: PCT/NO03/00224

§ 371 (c)(1),
(2), (4) Date: Jul. 20, 2005

(87) PCT Pub. No.: WO2004/027724

PCT Pub. Date: Apr. 1, 2004

(65) Prior Publication Data

US 2006/0071771 A1 Apr. 6, 2006

(30) Foreign Application Priority Data

Jun. 28, 2002 (NO) ..... 20023176

(51) Int. Cl.
*G08B 29/00* (2006.01)

(52) U.S. Cl. ..... 340/506; 340/501; 340/517; 340/521; 340/626; 340/632; 340/539.1; 340/539.26; 200/61.03

(58) Field of Classification Search ..... 340/506, 340/517, 521, 577, 584, 628, 629, 630, 632, 340/870.17, 501, 539.1, 539.26, 626; 200/61.03
See application file for complete search history.

(56) References Cited

U.S. PATENT DOCUMENTS

| | | | | |
|---|---|---|---|---|
| 4,275,311 | A | 6/1981 | Agazzone et al. | |
| 4,853,690 | A * | 8/1989 | Mayer et al. | 340/544 |
| 5,838,243 | A * | 11/1998 | Gallo | 340/632 |
| 6,266,579 | B1 * | 7/2001 | Baraty | 700/275 |
| 6,380,852 | B1 | 4/2002 | Hartman et al. | |
| 6,392,538 | B1 * | 5/2002 | Shere | 340/539.26 |

(Continued)

FOREIGN PATENT DOCUMENTS

DE 4241862 A1 6/1994

(Continued)

*Primary Examiner*—Hung T. Nguyen
(74) *Attorney, Agent, or Firm*—Banner & Witcoff, Ltd.

(57) ABSTRACT

A device is described for a safety system on an installation in connection with the operation of a habitat (10) in which an object that is carrying out work which results in heat generation such as flames, sparks and the like, is isolated from the surroundings, and where an overpressure of air is set up in the habitat (10) to prevent ingress of flammable gases, and comprising systems for supply of electricity and overpressure air to the equipment inside the habitat, and also an alarm system which can warn of irregularities and the like. The device is characterized in that the safety system comprises a shut-down central (30) to which is connected a number of detectors (32-38) placed in or adjacent to the habitat, and that can register parameters such as gases, temperatures, changes in temperature, and also pressure conditions adjacent to or inside the habitat, and that the shut-down central (30) is arranged to shut down operation of the heat generating equipment when irregularities arise in the operation of the habitat.

11 Claims, 2 Drawing Sheets

U.S. PATENT DOCUMENTS

| | | | | |
|---|---|---|---|---|
| 6,484,951 | B1 * | 11/2002 | Mueller | 237/2 A |
| 6,774,802 | B2 * | 8/2004 | Bachinski et al. | 340/632 |
| 6,989,757 | B2 * | 1/2006 | Geoffrey J. et al. | 340/632 |

FOREIGN PATENT DOCUMENTS

| | | | |
|---|---|---|---|
| DK | 159167 | B | 9/1990 |
| GB | 1383104 | | 2/1975 |
| GB | 2311847 | A | 10/1997 |
| WO | WO 0139222 | | 5/2000 |

* cited by examiner

DEVICE FOR SECURITY SYSTEMS FOR OPERATION OF HABITATS ON INSTALLATIONS

BACKGROUND OF THE INVENTION

The present invention relates to a device for a security system on an installation in connection with the operation of a habitat in which an object, in which work that involves heat production such as flames, sparks and the like is carried out and the like, is isolated from the surroundings, and where an overpressure of air is created in the habitat to prevent ingress of inflammable gases, and comprising systems for supply of electricity to equipment inside the habitat, and also air to establish an overpressure, and an alarm system that can warn of irregularities and the like.

A habitat means the same as a closed chamber, a utility tent, a house or the like where the object can be completely isolated from its surroundings. As a rule, such habitats are constructed from flame retardant cloth or aluminum or tin plates, adapted for the particular application case. The habitat can have a large number of different shapes, according to the specific objects the application.

In the following, the term habitat will be used for such closed room/chamber only.

Habitats are used in conditions where it is forbidden to use open fire or carry out work that leads to a danger of fire or explosions, such as heat generation, sparks and the like from welding, grinding, cutting and/or sandblasting. For example, typical tasks are when metal parts or pipes are to be welded together.

This is particularly the case for offshore oil-platforms where drilling for hydrocarbons is carried out and/or crude oil is produced. Such installations have as a rule their own separation system. If unintended heat generation of a given size arises in the relevant area, a risk of explosions can emerge due to ignition of oil and/or gas.

Therefore, the safety requirements are extra stringent for all such tasks on platforms. In spite of the stringent safety measures, today's habitats are still only equipped with a basic manometer to register the overpressure. Further it has been up to the operators inside the habitat to register this themselves and stop the welding process, etc., so that dangerous situations that can lead to fire or explosions do not arise. Occasionally, an additional system, which is related to the gas warning itself, is installed, so that the system will give out a warning if gas enters the area. However, there is no communication between these systems. One is still forced to rely on manual action by the operator to stop the welding.

SUMMARY OF THE INVENTION

In general, it is a great disadvantage with the present systems that they do not take safety into consideration in a satisfactory way, but by and large leave safety to the human factor, i.e. to the operators working in connection with the habitat.

Therefore, it is an aim of the invention to provide a new solution that eliminates the abovementioned problems.

In more detail, it is an aim of the invention to provide a solution that removes more of the risk associated with heat tasks on offshore or onshore petrochemical installations.

Thus, it is a further aim to provide a solution that will imply a more comprehensive safety philosophy than today's solution.

The device according to the invention is characterised by the features that are given in the characteristic in the subsequent claim 1.

The preferred embodiments of the arrangement according to the invention appear in the dependent claims 2-9.

By the invention as it is defined, considerable progress is made in regard to safety at such habitat systems. Thus, an automatic solution is provided that removes the human risk element.

At detection of gas, temperature being too high, the rate of increase in the temperature being too high, and the pressure being too low, the electricity to the ignition source or the heat or spark forming equipment that is used inside the habitat is shut off. The electricity to these ignition sources is also shut off at a loss in overpressure.

If one uses air from another system than the installation's own compressed air system, this will also be incorporated in the inventive shut-down system, which will result in the electricity to the ignition source being shut off if the overpressure is lost. This will also occur if inflammable gases are to enter the overpressure air unexpectedly. The detector will in such cases signal this to the shut-down central which will then shut off the air supply.

Before going on to describe the invention with reference to the figures and illustrations, the following definitions shall be presented:

Manometer:

A pressure measuring instrument which transmits a signal to the "shut-down central" when it registers a pressure that is lower than a given value (necessary overpressure). The electricity supply to the welding equipment and the like is then simultaneously shut off.

Gas Detector:

Detector that sends a signal to the "shut-down central" at detection of abnormal levels of gases, in particular inflammable gases.

Temperature Sensor:

A sensor which registers temperatures. A number of sensors are placed inside and outside the habitat. Important parameters that are considered for a possible reaction are when the temperature is too high or when the temperature rises too fast, i.e. a change per unit time.

Fan:

Supplies air with an overpressure to the habitat. Shuts off automatically when the detector at the inlet registers abnormal levels of gas in the inlet air. The habitat can be supplied with air from the compressed air system of the platform itself (cf. FIG. 1).

Shut-Down Central:

A mobile, electro-equipment wagon including the necessary electronics to make the manometers, temperature sensors and gas detectors supply electrical signals to the shut-down unit such that electricity to the equipment (such as the ignition source) inside the habitat is shut off, apart from special equipment such as emergency lights and the light which shall remain switched on.

The system according to the invention can, as mentioned, be operated both with it's own internal fan system for the generation of the overpressure air, or can utilise the installation's own compressor system.

Additional features of the present invention will become apparent from the subsequent description with reference to the enclosed drawings, in which:

DETAILED DESCRIPTION OF THE INVENTION

A sufficient overpressure is achieved quickly when the habitat is of a smaller design. If the habitat is of a given size, the habitat can, in a known way, comprise an inlet sluice. The sluice comprises equipment to control the atmosphere inside the lock, both with regard to the type of gas and pressure.

Figure 1:
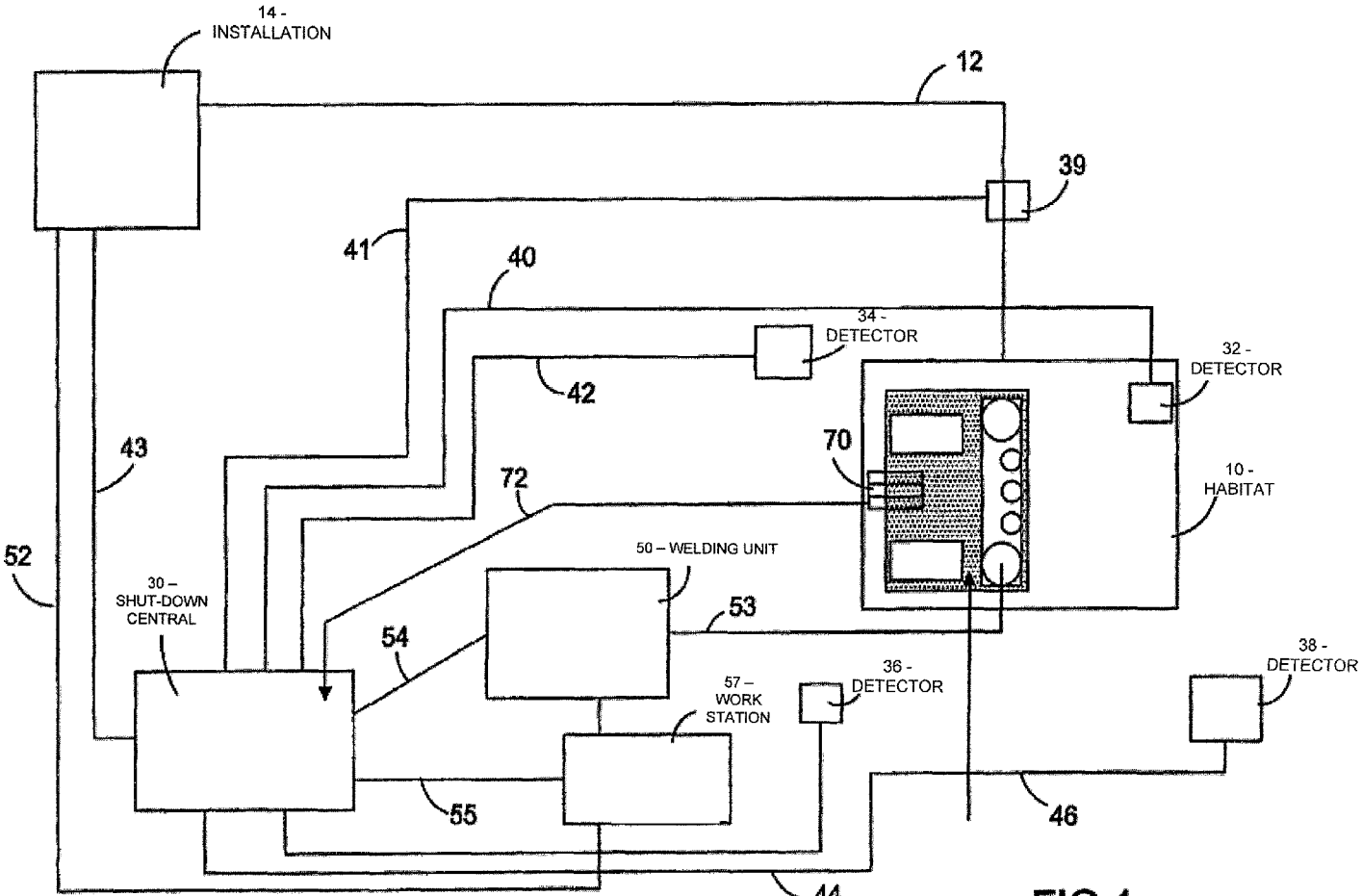
FIG. 1 shows schematically a first variant of the invention, and shows, among other things, how the habitat is connected to the installation's/the rig's own electricity supply, and is also supplied with compressed air from the installation.

In FIG. 1, the habitat is shown with the reference number 10. The habitat 10 forms as mentioned a closed space to isolate the carrying out of heat generating tasks. A line 12 for compressed air connects the habitat 10 to an installation 14 which can be a drilling platform or an oil production platform. The line can supply compressed air from the installation's 14 own compressed air system to maintain an inner overpressure in the habitat 10 at a given level in relation to the surroundings.

A central element in the safety arrangement is the shut-down system of a mobile multi-channel shut-down central shown by 30. A number of detectors are connected thereto. One or more detectors 32 (only one is shown in the figure) are placed inside the habitat 10, and a series of other detectors 34, 36, 38 are connected and placed in the area round the habitat. A detector, which is not shown, can be arranged in the area where the platform's compressed air enters the habitat. The detectors 32-38 comprise sensors sensing gases, and in particular hydrocarbon gases, and also temperature and temperature increases, and in addition, pressure and pressure changes both inside and in the area adjacent to the habitat. All these detectors are connected to the shut-down central 30 by way of lines 40, 42, 44, 46, respectively. A detector (such as a gas detector) 39 is also added to the line 12 that carries compressed air to the habitat 10 to control the inlet air. The detector 39 is connected to the shut-down central 30, by way of the line 41.

The shut-down central 30 comprises the necessary instrumentation to receive signals from the detectors 32-38, and 39, and also the equipment to carry out the necessary disconnection of electricity. In addition, it contains a computer unit which is connected to the surveillance system of the installation 14. The computer unit can be programmed such that one can set the necessary parameters for the surveillance of the habitat, such as type of gas, temperatures, pressure, etc. The surveillance system of the installation 14 can, according to one option, override the shut-down central 30, and order the shutting off of all electricity supply to the habitat. This can also occur when irregularities (such as gas leaks, fire and the like) occur on the installation itself. In addition, the shut-down central 30 is connected to the installation's 14 electricity supply by way of the line 41.

The shut-down central 30 is lightweight so that it is easy for a few people to mount all the sensors at the right places. In total, the whole system according to the invention, is very mobile, and can easily and quickly be moved around on an installation. The complete connecting-up of the equipment can be done very quickly.

The welding unit is shown schematically by 50 and is, by way of the cable 52, directly connected for electricity to the electricity supply of the installation 14, for example, with a voltage of 480 volt, and a frequency of 60 Hz. The line 53 connects the welding unit to the welding equipment that is inside the habitat 10. (Correspondingly, units for electricity supply to grinding equipment and other types of equipment can be arranged inside the habitat). The welding unit 50 is, by way of line 54, also connected to the shut-down central 30. Furthermore, the shut-down central 30 is connected, by way of line 55, to a workstation 57 that can distribute electricity, for example, from the platform, and the welding equipment which requires a voltage of about 450-500 volt (60 Hz) and other equipment such as detectors that require electricity at a lower voltage (230 volt).

Furthermore, the system comprises a number of light indication points, for example with green colour, both inside and outside the habitat which can signal that the installation 14 is in a so-called OK state, that everything is functioning as intended. If something abnormal happens on the installation 14, this can be signalled in that the light indication points change colour to, for example, red or yellow flashing light Also installed inside the habitat is a manometer 70, which, by way of line 72, is connected to the shut-down central 30. The manometer 70 measures the pressure inside the habitat 10, and the surveillance system of the shut-down central 30 is set so that when the manometer indicates that the pressure inside the habitat 10 falls below a given value, for example, when the pressure sinks to a value equal to or lower than a water column of 5 mm, then the electricity supply to the welding equipment and other units inside the habitat is shut off. Consequently, the manometer is used in the same way as the gas detectors, i.e. that the electricity supply is shut off when the pressure falls below a given value, or when one gets a rapid pressure drop inside the habitat which exceeds a given value per unit time.

With the help of this system, the new control system in the form of the shut-down central 30 with detectors, can automatically control and regulate the process inside the habitat.

It can be seen in FIG. 1 that the shut-down central 30 is only electrically connected to the installation. The system itself will take care of the safety around the habitat. If something irregular happens around the habitat, the electricity to the units in operation is shut off. Safety-wise this will be more than sufficient. The limit values which the different detectors are set at will normally be lower than the limit values which are used on such an installation. Therefore, the habitat system according to the invention has an in-built safety which is sufficient for the purpose.

The shut-down central 30 receives its supply of electricity from the installation. Furthermore, the connection is formed so that if an irregular situation arises on the installation, then it will shut off the electricity to the detector system itself.

The system according to the invention can be delivered with one or two (or more) electricity connections to the installation, dependent on how much electricity the equipment inside the habitat requires. A situation with 2 such connections is shown in the figures, a connection through cable 43 for 230 volt for the less electricity demanding equipment inside the shut-down central 30, and a 480 volt connection, shown by the reference number 52, for the larger equipment, such as welding equipment and the like, which are used inside the habitat.

Figure 2:
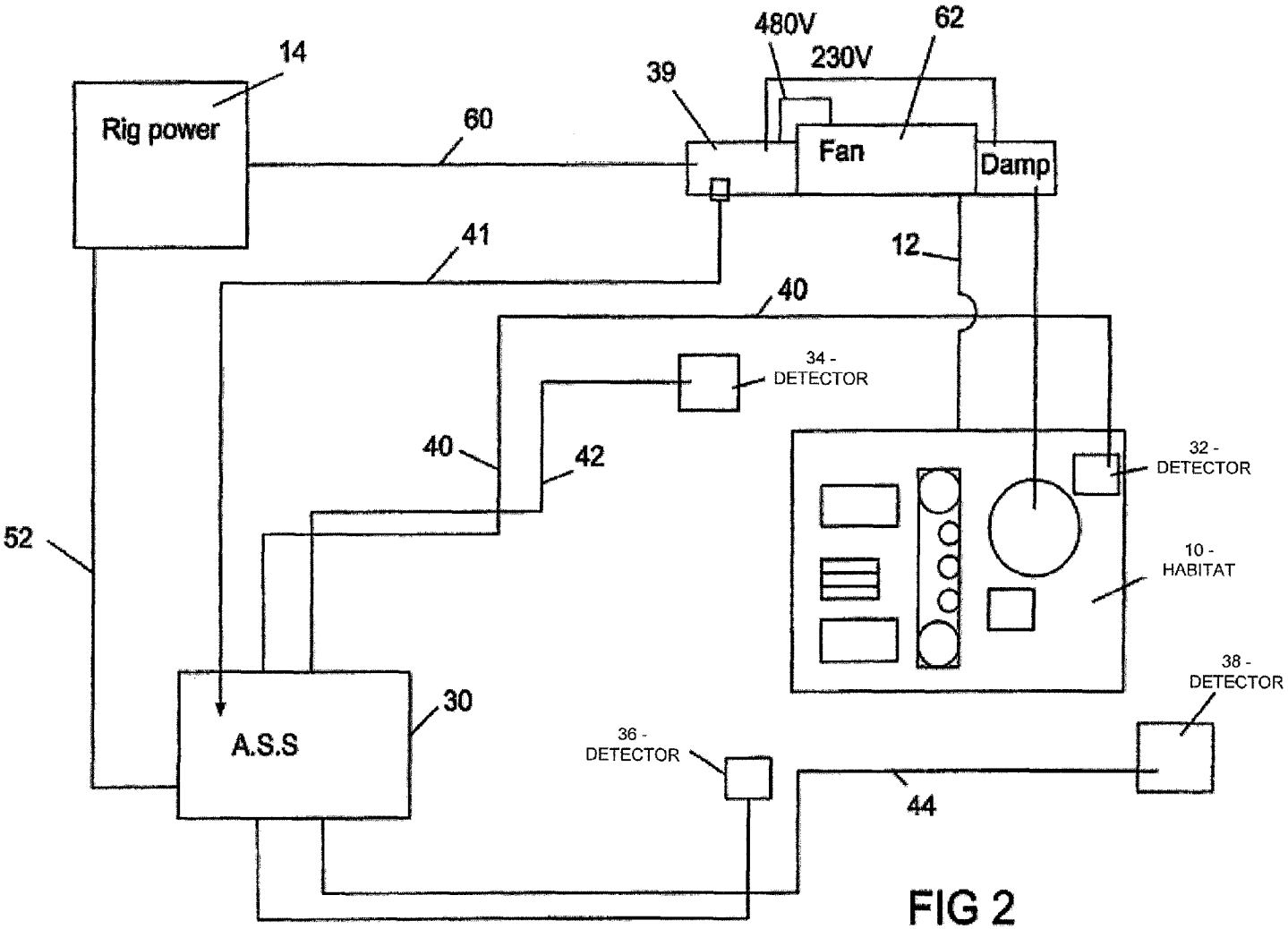
FIG. 2 shows schematically a second variant of the invention, where the habitat is supplied with electricity from its own fan unit.

In the embodiment shown in FIG. 2, compressed air is produced in a separate compressed air plant 62 in connection to the habitat. But the current supply to the compressed air plant is provided by the electricity plant of the platform. This takes place through the line 60 which leads electricity at the higher voltage (for example 480 volt) for the operation of welding equipment inside the habitat, and also a separate line for electricity at the lower voltage of 230 volt. The habitat comprises its own fan unit 62, placed in a safe zone, and which conducts the overpressure air to the habitat 10 by way of line 12. A detector 39 in the air inlet of the fan is, by way of line 41, also connected to the shut-down central 30, and can detect unwanted gas and the like at the air inlet, and the shut-down central 30 can, in such a case, react by shutting off all electricity supply to the habitat.

The electricity cables that connect together the individual elements of the system are shown in the figures. However, it is obvious that this also implies a connection between the warning systems.

The operator himself can step in and manually override the new system according to the invention. However, to a large extent with the new invention, the uncertainty which lies in the human factor in the way such habitats have been operated previously, has been removed.

Normally, there is no need for the installation to be able to control the operation of the fitted habitat-detector system and the associated equipment. In other words, it is sufficient with one electricity connection, and that the installation can shut off the electricity in abnormal situations.

Furthermore, a complete connection will require more comprehensive fitting effort when the habitat is to be installed. The aim of the invention is that the habitat unit shall easily be fitted in a short space of time and be operational quickly.

Nevertheless, the possibility of connecting together the systems shall be mentioned so that the installation's own control system can monitor all the habitat functions, and then shut off the electricity supply when something abnormal arises in the habitat itself.

This means, for example, that the electricity supply to the welding equipment, grinding equipment, sandblasting equipment and the like inside the habitat, and also signals from the different detectors, can be monitored and controlled from the installation's control centre. The connection can, for example, be such that when faults occur in the installation that result in special security measures being initiated, then the system also disconnects all electricity supply to the instruments and equipment that are running inside the habitat, possibly by way of the shut-down central.

The invention will find use in offshore and onshore oil installations, in refineries, within the chemical industry and at other plants where it is necessary with habitat solutions when heat generating tasks are to be carried out.

The invention claimed is:

1. A device for a safety system for an installation, comprising:

a plurality of detectors placed in or adjacent to a habitat in which equipment that carries out work on an object inside the habitat results in heat generation that is isolated from the surroundings outside of the habitat, and where an overpressure of air is set up inside the habitat to prevent ingress of flammable gases, the overpressure of air from a compressed air source, the detectors adapted to register the overpressure of air inside the habitat;

an alarm system that can warn of irregularities; and a mobile shut-down central unit to which the detectors and the alarm system are electrically connected, the mobile shut-down central unit comprising a computer unit to set the overpressure for surveillance of the habitat, and the mobile shut-down central unit is arranged to control the power supply to the heat generating equipment inside the habitat.

2. The device in accordance with claim 1, wherein the mobile shut-down central unit shuts down the supply of electricity or air, or both to the heat generating equipment.

3. The device in accordance with claim 1 or claim 2 wherein the mobile shut-down central unit is connected to the installation's own safety system, and the shut-down central unit's control of the habitat is configured to be overridden by the installation's own safety system.

4. The device in accordance with claim 3, wherein the installation's own safety system is arranged to monitor all the habitat's functions.

5. The device in accordance with any one of claims 1-4, wherein the mobile shut-down central unit is electrically connected to the installation.

6. The device in accordance with any one of claims 1-5, wherein a detector in or adjacent to the compressed air inlet of the habitat is connected to the mobile shut-down central unit to control and be able to shut off the air supply of said compressed air.

7. The device in accordance with claim 6, wherein the overpressure of air to the habitat is supplied by the installation's compressed air system, and one of the number of detectors is disposed in or adjacent to the compressed air inlet of the habitat.

8. The device in accordance with claim 7 wherein the overpressure system of the habitat is connected to the installation's compressed air plant.

9. The device in accordance with any one of claims 1-8, wherein a pressure measuring instrument inside the habitat is connected to the shut-down central unit which can then react when the pressure in the habitat falls below a certain given pressure, or when there is a sudden drop in pressure that exceeds a given value per unit time inside the habitat.

10. The device in accordance with any one of claims 1-9, wherein the safety systems of the habitat and the installation are connected together such that the installation's own control system can monitor all the habitat functions by way of the shut-down central unit, and is arranged to shut off the electricity supply when an abnormal event arises inside the habitat.

11. The device in accordance with claim 1 wherein the plurality of detectors are further adapted to register gases, temperatures, changes in temperature, and pressure conditions adjacent to the habitat.

* * * * *